US009610677B2

(12) United States Patent
Reichler et al.

(10) Patent No.: US 9,610,677 B2
(45) Date of Patent: Apr. 4, 2017

(54) HAND-HELD POWER TOOL

(75) Inventors: Mark Reichler, Remshalden (DE); Klaus-Martin Uhl, Plochingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 712 days.

(21) Appl. No.: 13/370,333

(22) Filed: Feb. 10, 2012

(65) Prior Publication Data

US 2012/0211248 A1 Aug. 23, 2012

(30) Foreign Application Priority Data

Feb. 17, 2011 (DE) ..... 10 2011 011 390

(51) Int. Cl.
*B25F 5/00* (2006.01)
*B25F 5/02* (2006.01)

(52) U.S. Cl.
CPC . *B25F 5/02* (2013.01); *B25F 5/00* (2013.01)

(58) Field of Classification Search
CPC ... B25F 5/00; B25F 5/02; B25B 21/00; B25B 23/1475; B23Q 1/0009; B23Q 15/00
USPC ..... 173/20, 217, 1; 116/216; 123/2
See application file for complete search history.

(56) References Cited

U.S. PATENT DOCUMENTS 5,499,597 A * 3/1996 Kronberg ..... 116/216
5,595,153 A * 1/1997 Hoppner ..... B27B 17/00 123/198 E
6,708,661 B1 * 3/2004 Aubourg et al. ..... 123/179.16
7,021,251 B2 4/2006 Ohmori et al.
7,299,963 B2 * 11/2007 Moeller et al. ..... 228/8
8,586,886 B2 11/2013 Nemetz
2007/0044983 A1 * 3/2007 Wuensch et al. ..... 173/217
2007/0193762 A1 8/2007 Arimura et al.
2009/0236109 A1 * 9/2009 Wu et al. ..... 173/20
2010/0186975 A1 7/2010 Glauning
2010/0224384 A1 * 9/2010 Gwosdz et al. ..... 173/217
2011/0056451 A1 * 3/2011 Geyer ..... 123/179.16

FOREIGN PATENT DOCUMENTS

| | | | |
|---|---|---|---|
| CN | 1532027 | | 9/2004 |
| CN | 101026298 | | 8/2007 |
| DE | 26 21 053 | A1 | 12/1977 |
| DE | 203 16 470 | U1 | 10/2003 |
| DE | 102009040321 | A1 * | 3/2011 |
| EP | 2 140 984 | A2 | 1/2010 |
| JP | 2006 272485 | A1 | 10/2006 |
| JP | 2008-180187 | A | 8/2008 |
| JP | 2011-005628 | A | 11/2011 |
| RU | 2281854 | | 8/2006 |
| WO | 2010/093755 | A1 | 8/2010 |

* cited by examiner

*Primary Examiner* — Michelle Lopez
*Assistant Examiner* — Chinyere Rushing-Tucker
(74) *Attorney, Agent, or Firm* — Gudrun E. Huckett

(57) ABSTRACT

A hand-held power tool has a housing with a cylinder chamber. An internal combustion engine is arranged in the housing and the internal combustion engine has a cylinder arranged in the cylinder chamber. A device is provided that detects temperature information in the cylinder chamber when the internal combustion engine is in an inoperative state. An indicator device that indicates the temperature information is provided.

15 Claims, 2 Drawing Sheets

HAND-HELD POWER TOOL

BACKGROUND OF THE INVENTION

The invention relates to a hand-held power tool comprising a housing in which an internal combustion engine is arranged, wherein the internal combustion engine comprises a cylinder that is arranged in a cylinder chamber provided within the housing.

DE 203 16 470 U1 discloses a motor chainsaw that has an indicator device for indicating operation parameters or condition parameters of the drive device. In hand-held power tools, it is also known to arrange a temperature sensor on the cylinder or the crankcase. However, the operation of the temperature sensor requires energy. In many cases, hand-held power tools are operated without an additional energy supply, for example, in the form of a battery or battery pack. The energy is provided exclusively by the internal combustion engine. When the internal combustion engine is turned off, the temperature sensor is without energy supply and therefore inoperative.

In hand-held power tools, the operator can usually select a cold start adjustment or a warm start adjustment when starting the motor. The start adjustment depends significantly on how much time has elapsed since the last operation of the internal combustion engine. The ambient temperature also plays a role. Primarily inexperienced operators do not always recognize easily whether an engine that has been shut down for a while can still be started under warm start conditions or whether a cold start is required. When starting an engine that is still warm under cold start conditions, an excessively rich fuel/air mixture may be produced so that starting is possible only with difficulty.

SUMMARY OF THE INVENTION

It is an object of the present invention to provide a hand-held power tool of the aforementioned kind that enables the operator to determine in a simple way whether cold start or warm start should be selected.

In accordance with the present invention, this is achieved in that the power tool has a device that detects temperature information within the cylinder chamber when the internal combustion engine is turned off and further has an indicator device for indicating the temperature information.

It has been found that for a sufficiently reliable indication whether cold start conditions or warm start conditions are present, it is not necessary to measure the cylinder temperature itself but the temperature within a cylinder chamber is sufficient. Since the temperature in the cylinder chamber is significantly lower than the cylinder temperature itself, the temperature in the cylinder chamber can be detected with simple means. The indicator device enables the operator to select the most favorable start adjustment. The device that detects the temperature information can be active also in operation of the internal combustion engine. For indicating cold start conditions or warm start conditions, the detection of the temperature information during operation of the internal combustion engine is however of subordinate importance. It may therefore be provided that the device that detects the temperature information is switched off during operation of the engine or is designed such that it can be switched off by the operator, if desired.

Advantageously, the temperature information indicates whether the temperature is above or below a temperature threshold value. It is not necessary to detect or measure the absolute temperature in order to indicate whether cold start conditions or warm start conditions are present. It is sufficient to determine whether the current temperature is above or below a temperature threshold value. For temperatures below the temperature threshold value, cold start conditions exist and, for temperatures above the temperature threshold value, warm start conditions exist. Therefore, the device that detects the temperature information and the indicator device can be of a simple configuration. Advantageously, the internal combustion engine, below a switching temperature of the cylinder, is to be started with cold start adjustment and above the switching temperature with warm start adjustment. In order to determine whether the operator should select the cold start adjustment or warm start adjustment, for example, by adjusting an operating mode selector that is to be moved into a cold start position or a warm start position, the cylinder temperature is therefore a decisive factor. The device that detects the temperature information is advantageously arranged on the power tool such that the temperature threshold value exists at the device that detects the temperature information when the switching temperature exists at the cylinder. With the predetermined arrangement of the device that detects the temperature information, it can therefore be detected with simple means whether the cylinder temperature is above or below the switching temperature.

The indicator device is advantageously visible from the exterior of the housing. A simple configuration results when the device that detects the temperature information is integrated into the indicator device. The device that detects the temperature information and the indicator device comprise advantageously a thermochromic material. Thermochromic materials are materials that change their color as a function of temperature. In this way, it can be indicated in a simple way whether the temperature in the cylinder chamber is above or below a temperature threshold value. For thermochromic materials no energy supply is required so that the temperature information can still be indicated when the internal combustion engine is shut down (inoperative state). An especially simple and favorable design results when the device that detects the temperature information and the indicator device are formed by a film indicator (film display) with liquid crystals. Since the cylinder temperature is not measured directly but instead the temperature in a cylinder chamber is determined, conventional film (plastic strip) indicators as they are known, for example, in case of plastic strip thermometers, can be used. In contrast to plastic strip thermometers that indicate the temperature in temperature steps of, for example, 2 degrees C. with different elements, the film display or indicator according to the invention requires only one temperature range, i.e., one element of a plastic strip thermometer, is sufficient.

Advantageously, the cylinder chamber is covered at least partially by a cover wherein the device that detects the temperature information and the indicator device are arranged in an area of the cover that delimits the cylinder chamber. In this way, a simple configuration is provided. In particular, a film (plastic strip) indicator can be adhered or glued to the cover. In order to achieve sufficiently high temperatures and sufficiently fast temperature fluctuation responses with the device that detects the temperature information, it is provided that the device that detects the temperature information is arranged adjacent to the cylinder on the cover. The area is selected such that the changeover point of the film (plastic strip) indicator that corresponds to the temperature threshold value coincides with the change of the start conditions between cold start conditions and warm start conditions. The power tool has in particular a grip that extends across the housing. In order to reduce the effect of solar radiation on the measured result, it is provided that the indicator device is arranged at least partially underneath the grip. Accordingly, the indicator device is at least partially shaded by the grip and the effect of direct solar radiation is reduced.

It may also be advantageous that the device that detects the temperature information is arranged at a spacing from the cylinder chamber and is connected by means of a heat conducting element with the cylinder chamber. Advantageously, the power tool has an operating mode selector by means of which in particular warm start conditions and cold start conditions can be adjusted. The indicator device is advantageously arranged adjacent to the operating mode selector. In this way, it is indicated to the operator directly at the location where the adjustment operation is to be performed how the operating mode selector is to be adjusted or positioned. Advantageously, the device that detects the temperature information comprises at least two elements with different thermochromic characteristics, i.e., different changeover point and/or different color change. Advantageously, one of the elements has a cold start symbol assigned and the other element has a warm start symbol assigned. A particularly simple operation results when also on the operating mode selector at least one symbol is arranged, wherein the at least one symbol of the operating mode selector matches the at least one symbol of the indicator device.

DESCRIPTION OF THE PREFERRED EMBODIMENTS

Figure 1:
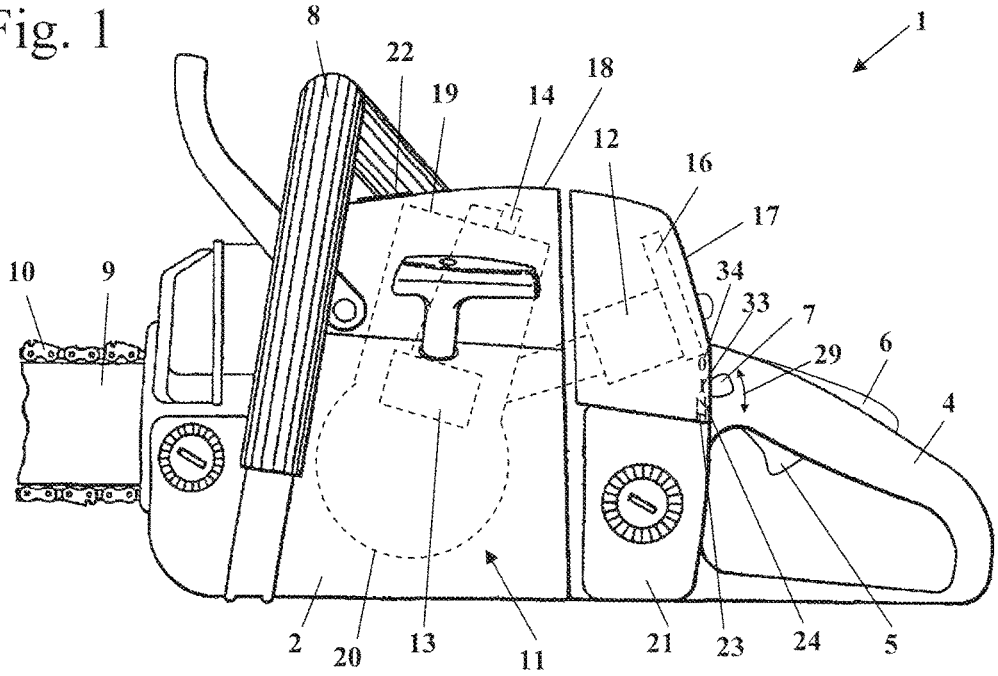
FIG. 1 is a schematic side view of a motor chainsaw.

FIG. 1 shows an embodiment of a hand-held power tool 1 in the form of a motor chainsaw. The power tool can also be a cut-off machine, a trimmer or the like. The power tool 1 has a housing 2 in which an internal combustion engine 11 is arranged. The internal combustion engine 11 can be, for example, a two-stroke engine or a four-cycle engine. The housing 2 has a cover 18 that closes off a cylinder chamber 31 formed within the housing 2 and illustrated schematically in FIG. 2.

The power tool has a rear handle 4 on which a hand throttle 5 and throttle lock 6 are pivotably supported. Adjacent to the rear handle 4 an operating mode selector 7 is arranged on the housing 2 and can be pivoted in the direction of double arrow 29. The operating mode selector 7 has a stop position, an operating position, a warm start position, and a cold start position. Adjacent to the operating mode selector 7, a stop symbol 34, an operating symbol 33, a cold start symbol 23, and a warm start symbol 24 are arranged on the housing 2 so as to correlate with the appropriate positions of the operating mode selector 7.

On the side that is facing away from the rear handle 4, a guide bar 9 projects forwardly; a saw chain 2 is arranged on the guide bar 9 and is driven by the internal combustion engine 11. On the side that is facing the guide bar 9, a grip 8 extends across the housing 2 and is positioned at a spacing from the housing 2.

Figure 2:
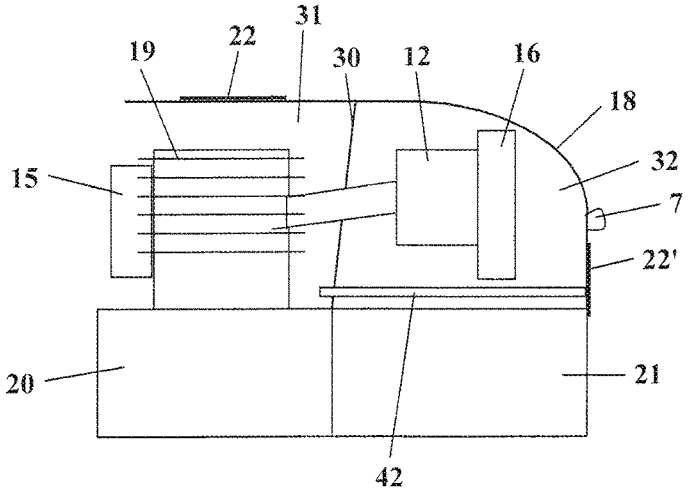
FIG. 2 is a schematic illustration of an embodiment of a motor chainsaw.

The internal combustion engine 11 takes in combustion air through air filter 16 and carburetor 12. The air filter 16 is arranged in a carburetor chamber 32, illustrated in FIG. 2, and in the embodiment according to FIG. 1 is closed off by a separate air filter cover 17. As shown in FIG. 2, the air filter cover 17 can also be formed integrally with the cover 18 so that the cover 18 covers the cylinder chamber 31 as well as the carburetor chamber 32.

As shown in FIG. 1, the internal combustion engine 11 has a crankcase 20 and a cylinder 19. The internal combustion engine 11 has moreover an ignition module 13 that is connected to a spark plug 14. The spark plug 14 projects into a combustion chamber that is formed within the cylinder 19. The spark plug 14 ignites the mixture in the combustion chamber. As shown in FIG. 1, an indicator device 22 is arranged adjacent to the cylinder 19 on the cover 18. Adjacent to the rear handle 4 the power tool also has a fuel tank 21. A muffler 15 is arranged on the cylinder 19; see FIG. 2.

As shown in FIG. 2, the cylinder chamber 31 and the carburetor chamber 32 are essentially separated by a partition 30. In the cylinder chamber 31 high temperatures exist because the cylinder chamber 31 is heated by the cylinder 19. The carburetor chamber 32 is relatively cold compared to the cylinder chamber 31. Therefore, vapor bubble formation in the mixture system can be prevented. As shown in FIG. 2, the indicator device 22 is arranged adjacent to the cylinder chamber 31 on the cover 18, in particular arranged directly above cylinder 19. The temperature of this area of the cover 18 is substantially determined by the temperature of the cylinder 19. In this context, the effect of the ambient temperature, in comparison to the effect of the cylinder temperature, can be substantially neglected. The indicator device 22 comprises also a device that detects the temperature of the cylinder chamber 31. The indicator device 22 has for this purpose advantageously a thermochromic material. The latter is particularly in the form of liquid crystals. The indicator device 22 is in particular a film (plastic strip) indicator with liquid crystals. It has been found that when arranging the indicator device 22 above the cylinder 19 on the cover 18, a film indicator that has a changeover temperature in the range between approximately 20 degrees C. up to approximately 30 degrees C. can be used for indicating cold start conditions or warm start conditions. In this configuration, commercially available film (plastic strip) indicators can be used in order to indicate to the operator the presence of cold start conditions or warm start conditions; such indicators are of the kind used also in plastic strip thermometers. Cold start conditions exist when the temperature of the cylinder 19 is below a switching temperature and warm start conditions exist when the temperature of the cylinder 19 is above the switching temperature. The indicator device 22 is arranged in such a way on the cover 18 that at the indicator device 22 the changeover temperature of the film indicator exists when at the cylinder 19 the switching temperature exists. In this way, it is possible with the indicator device 22 to indicate whether cold start conditions or warm start conditions are existing. By a suitable positioning of the indicator device 22, for example, at an appropriate spacing relative to cylinder 19, or by an appropriate constructive configuration, it can be achieved that the changeover temperature is present at the film indicator when the cylinder 19 is at the switching temperature.

However, it can also be advantageous to arrange the indicator device 22' at a spacing from the cylinder chamber 31. In order to enable an arrangement adjacent to the operating mode selector 7 in the area of the carburetor chamber 32 and/or the fuel tank 21, the cylinder chamber 31 can be connected by means of a heat conducting element 42 to the indicator device 22'. In this way, the temperature of the cylinder chamber 31 is transmitted to the indicator device 22. The heat conducting element 42 can be, for example, an insulated metal wire or the like. In order to ensure that at the indicator device 22 the changeover temperature exists at the time when the cylinder 19 is at the switching temperature, it is also possible to create a suitable space in the hand-held power tool where the film indicator is then arranged.

It can also be advantageous to employ as an indicator device 22 an LED, a display, or the like. Advantageously, the indicator device 22 is then positioned adjacent to the operating mode selector 7 or directly at the operating mode selector 7.

Film indicators indicate the temperature relative to a temperature threshold value. Below the temperature threshold value the liquid crystals have a first color and above the temperature threshold value they have a second color.

Figure 3:
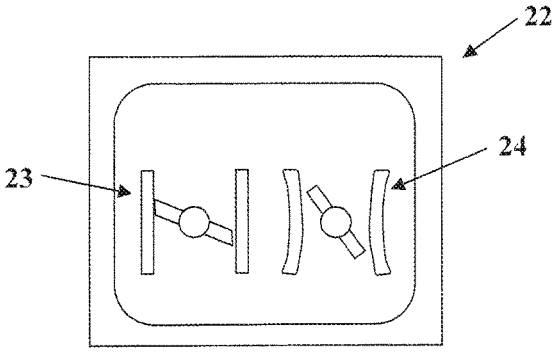
FIG. 3 is a schematic illustration of an indicator device.

FIG. 3 shows an embodiment for an indicator device 22 that has a cold start symbol 23 and a warm start symbol 24. Advantageously, the areas of the cold start symbol 23 and the warm start symbol 24 are equipped with liquid crystals of different color. In particular, the cold start symbol 23 is equipped with liquid crystals that appear blue below the temperature threshold value and the area of the warm start symbol 22 is equipped with liquid crystals that appear red above the temperature threshold value. The changeover temperatures or temperature ranges for the two types of liquid crystals can overlap or can be spaced from each other. When none of the symbols 23 and 24 is visible or both symbols 23, 24 are visible, the operator can use the cold start mode as well as the warm start mode for starting the engine.

Figure 4:
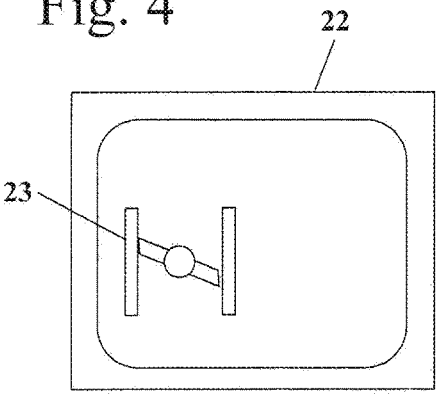
FIG. 4 is the indicator device of FIG. 3 at cold start conditions.

FIG. 4 shows the indicator device 22 at cold start conditions. The liquid crystals in the area of the cold start symbol 23 are illuminated, for example, they show a blue color. Liquid crystals in the area of the warm start symbol 24 exhibit at this temperature the same color as the background so that the warm start symbol 24 is not visible (is not displayed).

Figure 5:
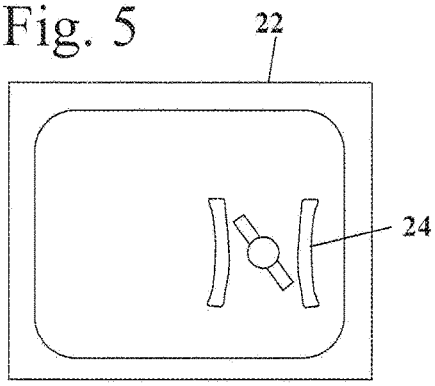
FIG. 5 is the indicator device of FIG. 3 at warm start conditions.

FIG. 5 shows the indicator device 22 at warm start conditions. The liquid crystals in the area of the cold start symbol 23 have the color of the background and the liquid crystals in the area of the warm start symbol 24 are contrasted relative to the background, for example, they display a red color. Particularly advantageous is a black background.

Figure 6:
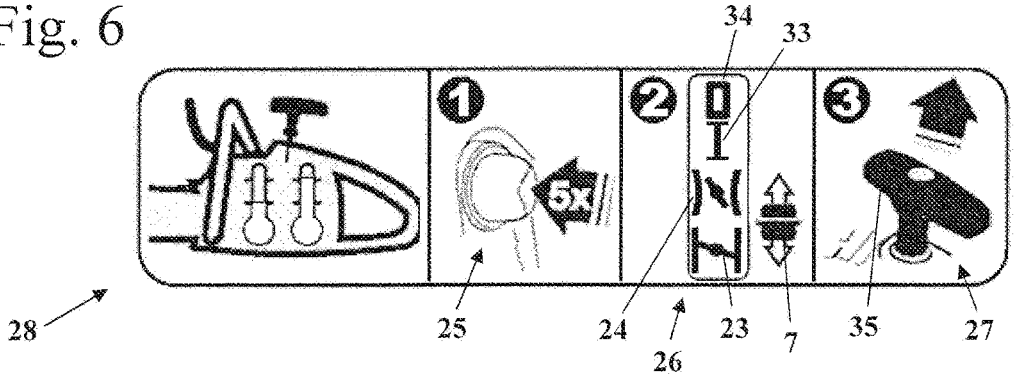
FIG. 6 is a schematic illustration of directions of use means for the operator.

FIG. 6 shows an example of a possible embodiment of directions of use means 28 for the operator, for example, provided as a sticker on the exterior side of the power tool 1 in order to facilitate the starting operation to be performed by the operator. In the area ❶ a purger symbol 25 is illustrated that signals to the operator that the purger should be suppressed five times. In the field ❷ an adjusting symbol 26 is indicated that shows a stop symbol 34, an operating symbol 33, a warm start symbol 24, and a cold start symbol 23. The illustrated symbols 23, 24, 33 and 34 correspond to the symbols adjacent to the operating mode selector 7. The operating mode selector 7 is also schematically shown in the field ❷. The field ❸ contains a start symbol 27 that signals to the operator that an operating grip 35 of a starting device of power tool 1 is to be actuated after adjusting the operating mode selector 7. The same symbols 23, 24 for cold start and warm start are provided on the indicator device 22, the operating mode selector 7, and the directions of use means 28.

Figure 7:
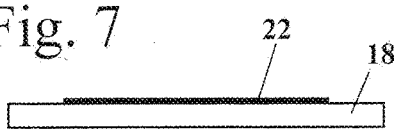
FIG. 7 is a schematic section illustration of an embodiment of the arrangement of the indicator device.

FIGS. 7 to 11 show different possibilities of arranging the indicator device 22. In FIG. 7, the indicator device 22, namely a plastic strip thermometer that detects temperature information and also indicates or displays it, is glued to the cover 18.

Figure 8:
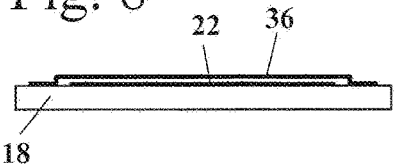
FIG. 8 is a variant of an arrangement of the indicator device in schematic section illustration.

In the design of FIG. 8, the indicator device 22 is also glued to the cover 18 and is additionally covered by a protective film 36.

Figure 9:
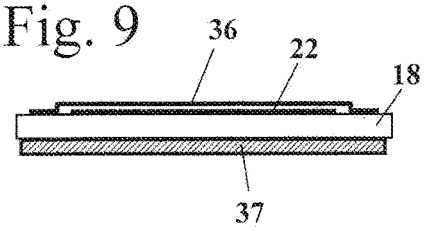
FIG. 9 is another variant of the arrangement of the indicator device in schematic section illustration.
Figure 10:
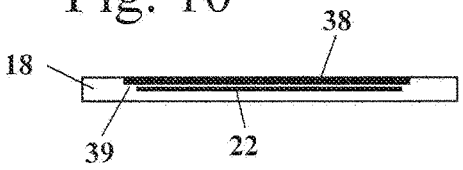
FIG. 10 is a further variant of the arrangement of the indicator device in schematic section illustration.

As shown a FIG. 9, on the inner side of the cover 18 a thermal insulation 37 can be arranged. This is in particular expedient when the temperatures at the exterior side of the cover 18 are too high so that the indicator device 22 would become damaged or warm start conditions would be indicated already at temperatures that still require cold start conditions.

When the temperature at the exterior side of the cover 18 is too low, the indicator device 22 can be arranged in a recess 39 of the cover 18. Above the indicator device 22 a port 38 can be positioned that, for example, is comprised of a transparent plastic material and that covers the indicator device 22 in upward direction and is flush with the exterior of the cover 18. Since the indicator device 22 is connected only by means of the thin plastic layer of the cover 18 to the cylinder chamber 31, higher temperatures can be achieved at the indicator device 22.

Figure 11:
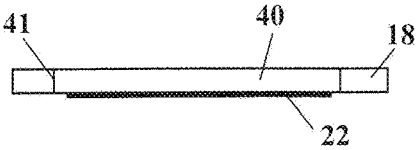
FIG. 11 is yet another variant of the arrangement of the indicator device in schematic section illustration.

In the embodiment illustrated in FIG. 11, the indicator device 22 is arranged on the inner side of the cover 18, i.e., within the cylinder chamber 31. In order for the indicator device 22 to be visible without problems from the exterior of the housing 2, the indicator device 22 is arranged at a port 40 that is secured in a recess 41 of the cover 18.

It can also be provided that the indicator device 22 has only a symbol for cold start or warm start. When the indicator device has a symbol for warm start conditions, cold start is to be adjusted when no symbol is showing. Likewise, in case of an indicator device 22 that has only a symbol for cold start conditions, warm start must be selected when no symbol is showing.

It can also be provided that the indicator device 22 in operation is inactive or switched off. This is in particular expedient in case of an electrical indicator device 22 such as an LED or a display. An indicator device that can be switched off by the operator may be advantageous also.

The specification incorporates by reference the entire disclosure of German priority document 10 2011 011 390.8 having a filing date of Feb. 17, 2011.

While specific embodiments of the invention have been shown and described in detail to illustrate the inventive principles, it will be understood that the invention may be embodied otherwise without departing from such principles.

What is claimed is:

1. A hand-held power tool comprising:

a housing delimiting a cylinder chamber;

an internal combustion engine arranged in said housing;

said internal combustion engine comprising a cylinder arranged in said cylinder chamber at a spacing to said cylinder chamber;

a device that detects temperature information when said internal combustion engine is in an inoperative state;

a visual indicator device that indicates visually said temperature information when said internal combustion engine is in the inoperative state;

wherein said device that detects said temperature information detects the temperature existing in said cylinder chamber, wherein the temperature existing in said cylinder chamber is lower than the temperature of the cylinder due to said spacing;

wherein said device that detects said temperature information and said indicator device require no separate energy supply so that said temperature information can be indicated when said internal combustion engine is in the inoperative state;

wherein said power tool comprises a cold start adjustment and a warm start adjustment, wherein said power tool should be started in said cold start adjustment when cold start conditions exist and should be started in said warm start adjustment when warm start conditions exist;

wherein said temperature information indicates whether the temperature is above or below a temperature threshold value, wherein cold start conditions exist at temperatures below said temperature threshold value and wherein warm start conditions exist at temperatures above said temperature threshold value.

2. The power tool according to claim 1, wherein said indicator device is visible from an exterior of said housing.

3. The power tool according to claim 1, wherein said device that detects said temperature information is integrated into said indicator device.

4. The power tool according to claim 3, wherein said device that detects said temperature information and said indicator device comprise a thermochromic material.

5. The power tool according to claim 4, wherein said device that detects said temperature information and said indicator device are formed by a film indicator with liquid crystals.

6. The power tool according to claim 1, comprising a grip that extends across said housing, wherein said indicator device is arranged at least partially underneath said grip.

7. The power tool according to claim 1, wherein said device that detects said temperature information is arranged at a spacing from said cylinder chamber and connected by a heat conducting element to said cylinder chamber.

8. The power tool according to claim 7, comprising an operating mode selector.

9. The power tool according to claim 8, wherein said indicator device is positioned adjacent to said operating mode selector.

10. The power tool according to claim 8, wherein, adjacent to said operating mode selector, at least one symbol is arranged that matches a symbol of said indicator device.

11. The power tool according to claim 1, wherein said device that detects said temperature information comprises at least two elements with different thermochromic characteristics.

12. The power tool according to claim 11, wherein a first one of said at least two elements has correlated therewith a cold start symbol and a second one of said at least two elements has correlated therewith a warm start symbol.

13. A hand-held power tool comprising:

a housing delimiting a cylinder chamber;

an internal combustion engine arranged in said housing;

said internal combustion engine comprising a cylinder arranged in said cylinder chamber at a spacing to said cylinder chamber;

wherein said power tool comprises a cold start adjustment and a warm start adjustment, wherein said power tool should be started in said cold start adjustment when a temperature of said cylinder is below a switching temperature of said cylinder and should be started in said warm start adjustment when the temperature of said cylinder is above said switching temperature of said cylinder;

a device that detects temperature information when said internal combustion engine is in an inoperative state, wherein said device that detects temperature information detects the temperature existing in said cylinder chamber, wherein the temperature existing in said cylinder chamber is lower than the temperature of the cylinder due to said spacing;

a visual indicator device that indicates visually said temperature information;

wherein said temperature information indicates whether the temperature is above or below a temperature threshold value, wherein cold start conditions exist at temperatures below said temperature threshold value and wherein warm start conditions exist at temperatures above said temperature threshold value;

wherein said device that detects said temperature information is arranged such on the power tool that, when said switching temperature exists at said cylinder, said temperature threshold value exists at said device that detects said temperature information.

14. A hand-held power tool comprising:

a housing delimiting a cylinder chamber;

a cover that delimits at least partially said cylinder chamber;

an internal combustion engine arranged in said housing;

said internal combustion engine comprising a cylinder arranged in said cylinder chamber at a spacing to said cover;

wherein said power tool comprises a cold start adjustment and a warm start adjustment, wherein below a switching temperature of said cylinder cold start conditions exist and the power tool should be started in said cold start adjustment and wherein above said switching temperature of said cylinder warm start conditions exist and the power tool should be started in said warm start adjustment;

a device that detects temperature information in said cylinder chamber when said internal combustion engine is in an inoperative state;

a visual indicator device that indicates visually said temperature information;

wherein said temperature information indicates whether a temperature is above or below a temperature threshold value, wherein cold start conditions exist at temperatures below said temperature threshold value and wherein warm start conditions exist at temperatures above said temperature threshold value;

wherein said device that detects said temperature information and said indicator device are arranged in an area of said cover, said area of said cover delimiting said cylinder chamber, such that said temperature threshold value exists at said device that detects said temperature information when said switching temperature exists at said cylinder, wherein a temperature existing in said cylinder chamber is lower than the temperature of the cylinder due to said spacing, and such that said indicator device is visible from an exterior of said housing.

15. The power tool according to claim 14, wherein said device that detects said temperature information is arranged adjacent to said cylinder on said cover.

* * * * *